US008111015B2

(12) United States Patent
Chang

(10) Patent No.: US 8,111,015 B2
(45) Date of Patent: Feb. 7, 2012

(54) BRIGHTNESS-ADJUSTABLE ILLUMINATION DRIVING SYSTEM

(75) Inventor: Shih-Hsien Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 337 days.

(21) Appl. No.: 12/414,496

(22) Filed: Mar. 30, 2009

(65) Prior Publication Data

US 2010/0127640 A1 May 27, 2010

(30) Foreign Application Priority Data

Nov. 24, 2008 (TW) ..... 97145398 A

(51) Int. Cl.
*H05B 37/02* (2006.01)

(52) U.S. Cl. ..... 315/307; 315/247; 315/297; 315/312

(58) Field of Classification Search ..... 315/224, 315/247, 274, 291, 294, 297, 307, 312
See application file for complete search history.

(56) References Cited

U.S. PATENT DOCUMENTS 5,394,064 A * 2/1995 Ranganath et al. ..... 315/209 R
5,719,474 A * 2/1998 Vitello ..... 315/307
5,747,942 A * 5/1998 Ranganath ..... 315/224
6,040,661 A * 3/2000 Bogdan ..... 315/224
6,674,252 B1 * 1/2004 Hsien ..... 315/291
7,804,256 B2 * 9/2010 Melanson ..... 315/291
2002/0153849 A1 * 10/2002 Ribarich ..... 315/247
2004/0239262 A1 * 12/2004 Ido et al. ..... 315/291
2009/0115342 A1 * 5/2009 Lam et al. ..... 315/276

* cited by examiner

*Primary Examiner* — Tung X Le

(74) *Attorney, Agent, or Firm* — Kirton & McConkie; Evan R. Witt

(57) ABSTRACT

An illumination driving system includes a control unit and at least one base. The control unit includes a first converter and a brightness-adjustable circuit. An input AC voltage is converted into a regulated DC voltage by the first converter. The brightness-adjustable circuit is connected to the first converter. The base is separated from the control unit for supporting the at least one light-emitting device. The base includes a second converter. The second converter is connected with the first converter and the light-emitting device for converting the regulated DC voltage into an output voltage. The light-emitting device is driven to illuminate by the output voltage. The brightness-adjustable circuit generates a brightness adjusting signal to the first converter. The magnitude of the regulated DC voltage is adjusted according to the brightness adjusting signal, thereby adjusting the brightness value of at least one light-emitting device.

16 Claims, 4 Drawing Sheets

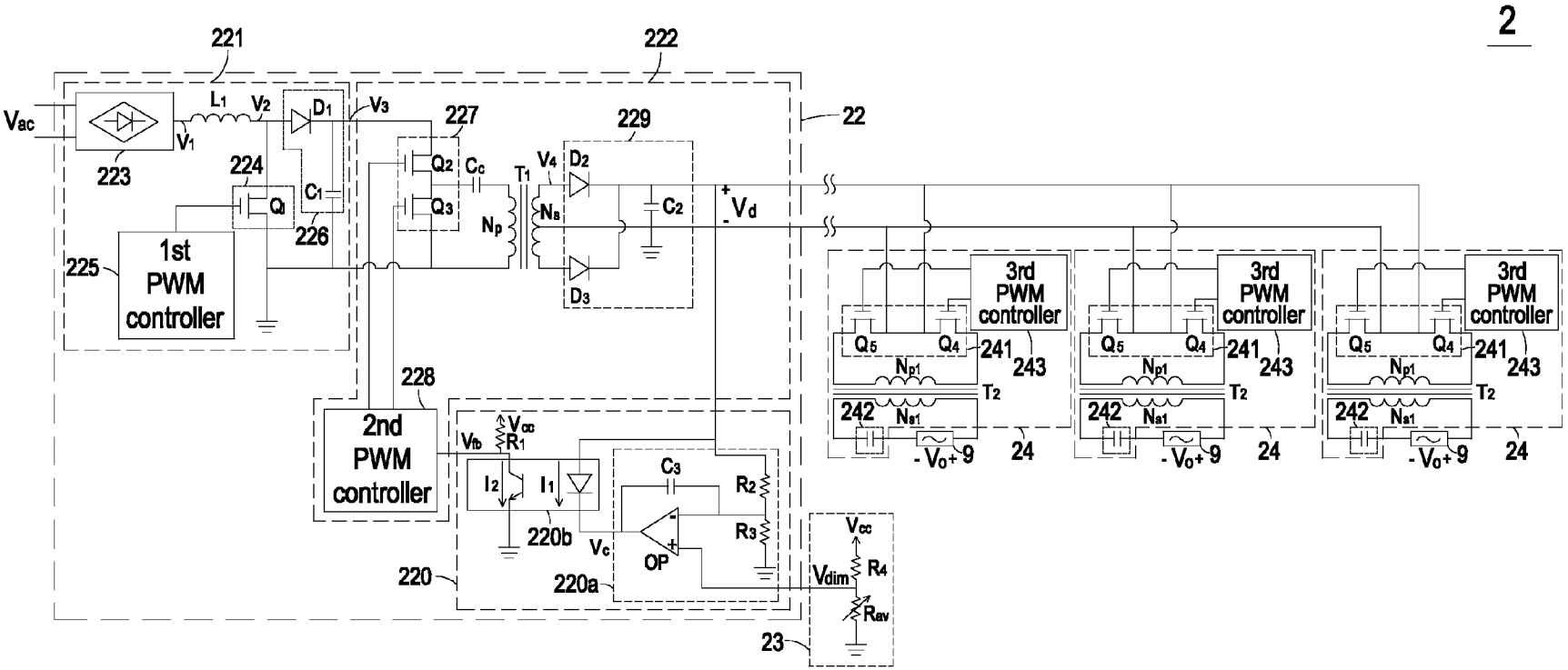
2
3rd PWM controller
3rd PWM controller
3rd PWM controller
1st PWM controller
2nd PWM controller
OP
Vac
Vd
Vo+9
Vo+9
Vo+9
Vcc
Vdim
Vc
Vb
Vs
Vf
Vf
Vf

BRIGHTNESS-ADJUSTABLE ILLUMINATION DRIVING SYSTEM

FIELD OF THE INVENTION

The present invention relates to an illumination driving system, and more particularly to a brightness-adjustable illumination driving system.

BACKGROUND OF THE INVENTION

Incandescent lamps such as tungsten filament lamps or halogen lamps are widely used as sources of artificial light. In the early stage, incandescent lamps are used for simply providing a bright place. With diversified living attitudes, incandescent lamps having difference brightness are developed. For adjusting brightness of respective incandescent lamp, a brightness-adjustable circuit is used to drive the incandescent lamp and control the brightness of the incandescent lamp.

FIG. 1 is a schematic circuit diagram illustrating a brightness-adjustable circuit for a conventional incandescent lamp. As shown in FIG. 1, the brightness-adjustable circuit 1 includes a switch element 11 and a triggering circuit 12. The switch element 11 is for example a solid semiconductor component such as a silicon-controlled rectifier (SCR) or a TRIode for Alternating Current (TRAIC) component. Take a TRAIC component as the switch element 11 for example. The control terminal G is the gate of the switch element 11. The first terminal $N_1$ and the control terminal G of the switch element 11 are coupled to the incandescent lamp 13 and the triggering circuit 12, respectively. The second terminal $N_2$ of the switch element 11 can receive the electric energy from the input voltage $V_{in}$. The triggering circuit 12 can control the on phase or on duration of the switch element 11, thereby controlling the electricity to be transmitted to the incandescent lamp 13.

Please refer to FIG. 1 again. The triggering circuit 12 includes a resistor R, a variable resistor $R_{var}$ a capacitor C and a bidirectional diode thyristor D. The resistor R, the variable resistor $R_{var}$ and the capacitor C are connected in serried with each other to form a charging loop. Both ends of these serially-connected components are coupled to the second terminal $N_2$ of the switch element 11 and the incandescent lamp 13, respectively. An end of the bidirectional diode thyristor D is coupled to the control terminal G of the switch element 11. The other end of the bidirectional diode thyristor D is coupled to the capacitor C. Through the charging loop which is defined by the resistor R, the variable resistor $R_{var}$ and the capacitor C, the input voltage $V_{in}$ can charge the capacitor C. Until the capacitor C is charged to the turn-on voltage of the bidirectional diode thyristor D, the bidirectional diode thyristor D is conducted and thus a triggering signal is transmitted to the control terminal G of the switch element 11. In response to the triggering signal, the switch element 11 is conducted. That is, the on phase or on duration of the switch element 11 can be controlled by adjusting the resistance of the resistor R, thereby controlling the electricity to be transmitted to the incandescent lamp 13 and adjusting the brightness of the incandescent lamp 13.

In recent years, light emitting diodes (LEDs) and cold cathode fluorescent lamps (CCFLs) that emit light with high brightness values and high illuminating efficiency have been developed. With the maturity of the LED or CCFL technology, LEDs and CCFLs will replace all conventional lighting devices in many aspects such as home-use lighting devices.

The conventional brightness-adjustable circuit 1, however, is only applicable to the incandescent lamp with the pure resistive property. If the conventional brightness-adjustable circuit 1 is applied to a cold cathode fluorescent lamp or a light emitting diode, the cold cathode fluorescent lamp or the light emitting diode fails to be normally operated and is possibly burnt out. In other words, the conventional brightness-adjustable circuit is not feasible to adjust brightness values of the cold cathode fluorescent lamp or the light emitting diode.

Therefore, there is a need of providing an improved brightness-adjustable illumination driving system so as to obviate the drawbacks encountered from the prior art.

SUMMARY OF THE INVENTION

An object of the present invention provides a brightness-adjustable illumination driving system for adjusting the brightness value of a cold cathode fluorescent lamp or a light emitting diode.

Another object of the present invention provides a brightness-adjustable illumination driving system, in which the control unit including a brightness-adjustable circuit is separated from the base, so that the control unit can remotely control the brightness value of the light-emitting devices.

In accordance with an aspect of the present invention, there is provided an illumination driving system for driving at least one light-emitting device and controlling a brightness value of the light-emitting device. The illumination driving system includes a control unit and at least one base. The control unit includes a first converter and a brightness-adjustable circuit. An input AC voltage is converted into a regulated DC voltage by the first converter. The brightness-adjustable circuit is connected to the first converter. The base is separated from the control unit for supporting the at least one light-emitting device. The base includes a second converter. The second converter is connected with the first converter and the light-emitting device for converting the regulated DC voltage into an output voltage. The light-emitting device is driven to illuminate by the output voltage. The brightness-adjustable circuit generates a brightness adjusting signal to the first converter. The magnitude of the regulated DC voltage is adjusted according to the brightness adjusting signal, thereby adjusting the brightness value of the light-emitting device.

The above contents of the present invention will become more readily apparent to those ordinarily skilled in the art after reviewing the following detailed description and accompanying drawings, in which:

BRIEF DESCRIPTION OF THE DRAWINGS

FIG. 4 is a schematic detailed circuit diagram of the brightness-adjustable illumination driving system as shown in FIG. 3.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
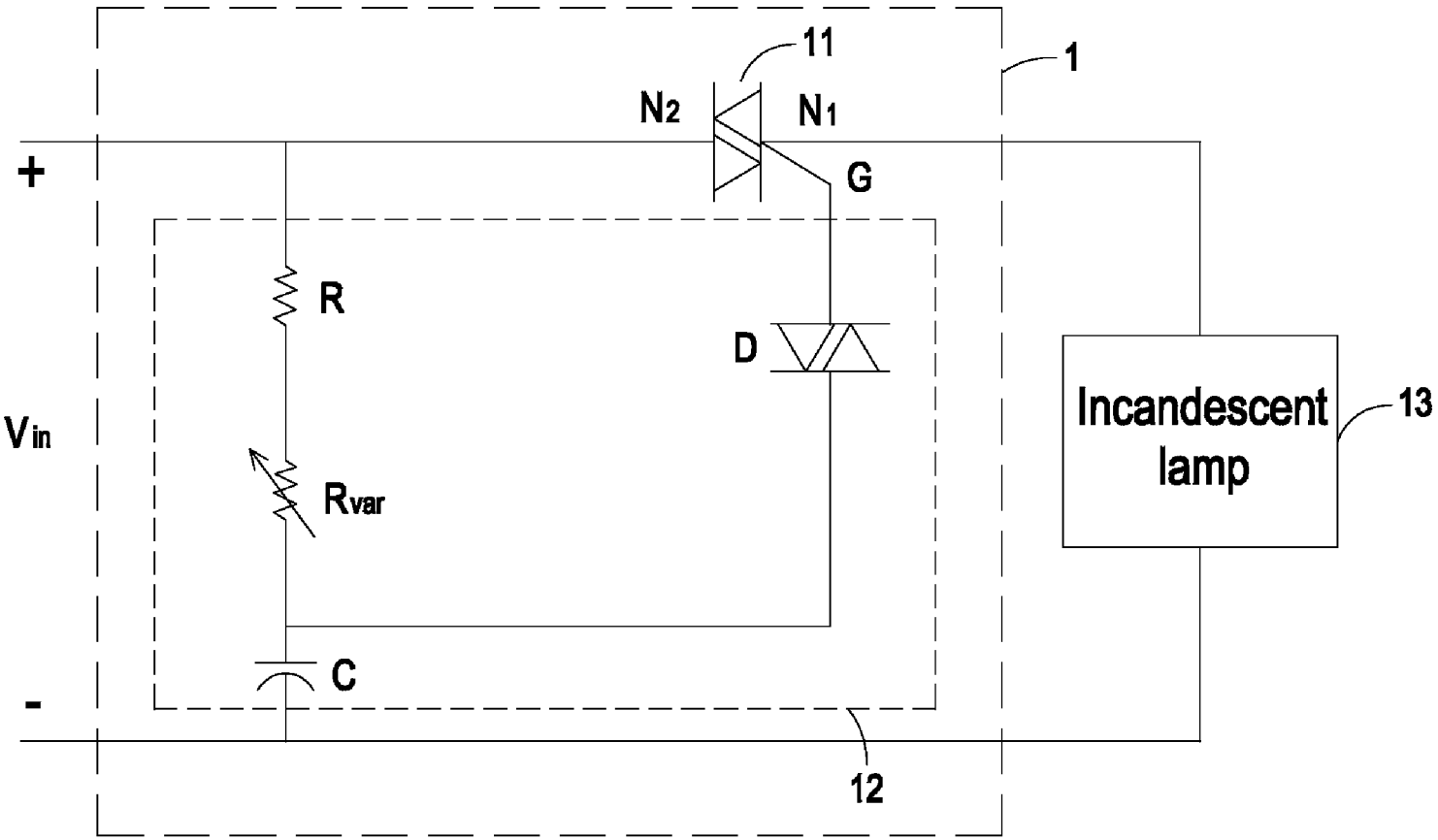
FIG. 1 PRIOR ART
FIG. 1 is a schematic circuit diagram illustrating a brightness-adjustable circuit for a conventional incandescent lamp.
Figure 2:
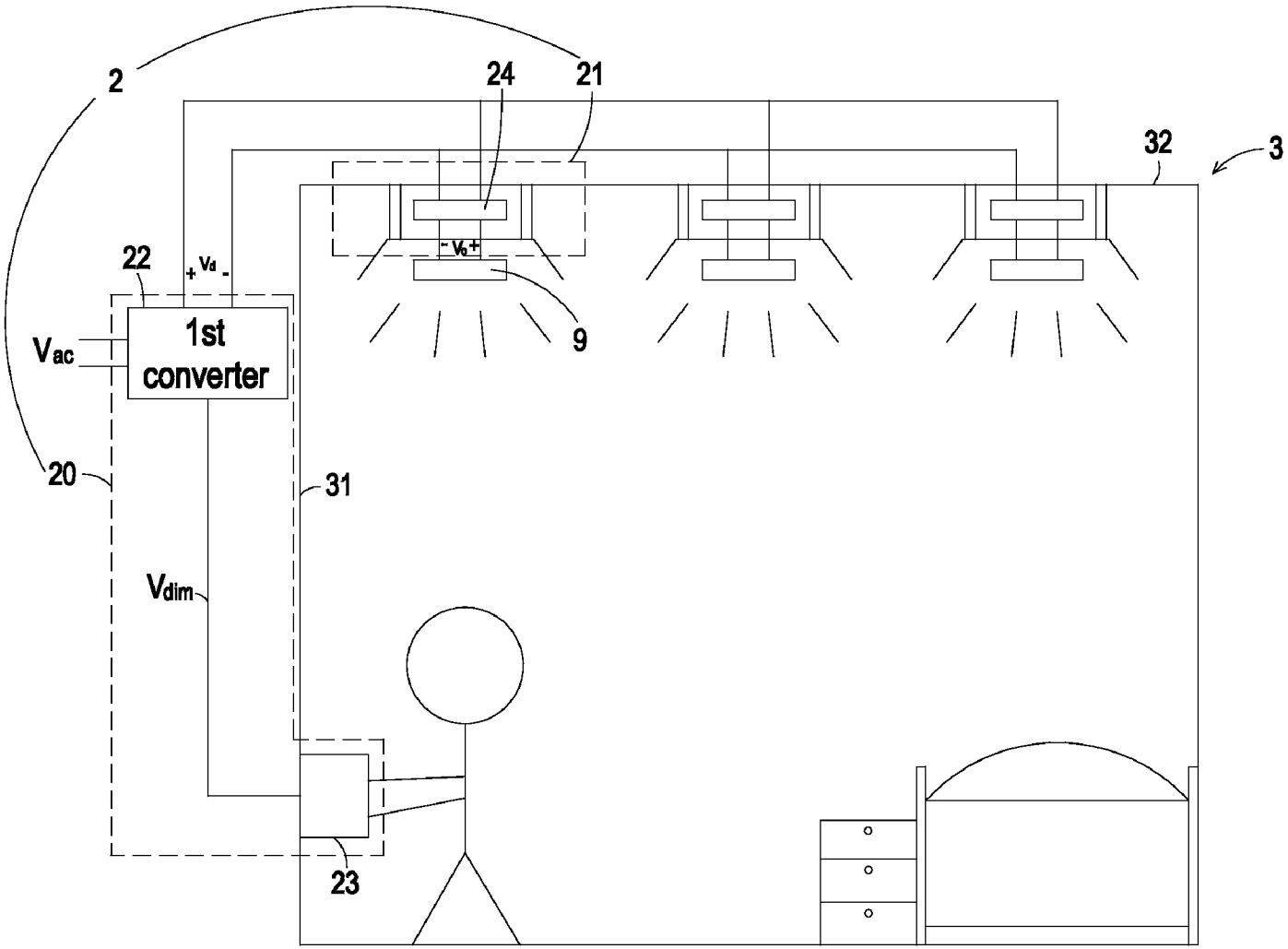
FIG. 2 is a schematic circuit diagram illustrating a brightness-adjustable illumination driving system for use in an indoor environment according to a preferred embodiment of the present invention.

FIG. 2 is a schematic circuit diagram illustrating a brightness-adjustable illumination driving system for use in an indoor environment according to a preferred embodiment of the present invention. The brightness-adjustable illumination driving system 2 is used for driving at least one light-emitting device 9 in the indoor environment 3 and controlling the brightness value of the light-emitting device 9. An example of the light-emitting device 9 includes but is not limited to a cold cathode fluorescent lamp (CCFL) or a light emitting diode (LED). The brightness-adjustable illumination driving system 2 can be also applied to outdoor environments.

Please refer to FIG. 2 again. The brightness-adjustable illumination driving system 2 principally comprises a control unit 20 and at least one base 21. In this embodiment, the brightness-adjustable illumination driving system 2 has a plurality of bases 21 and a plurality of light-emitting devices 9. The control unit 20 comprises a first converter 22 and a brightness-adjustable circuit 23. The light-emitting devices 9 are mounted on respective bases 21. In accordance with a key feature of the present invention, the bases 21 are separated from the control unit 20. For example, as shown in FIG. 2, the control unit 20 is disposed on a wall 31 of the indoor environment 3 and the bases 21 are disposed on the ceiling 32. As a consequence, the control unit 20 can remotely control the light-emitting devices 9. The configurations and the relations of the control unit 20 and the bases 21 will be illustrated in more details as follows.

Figure 3:
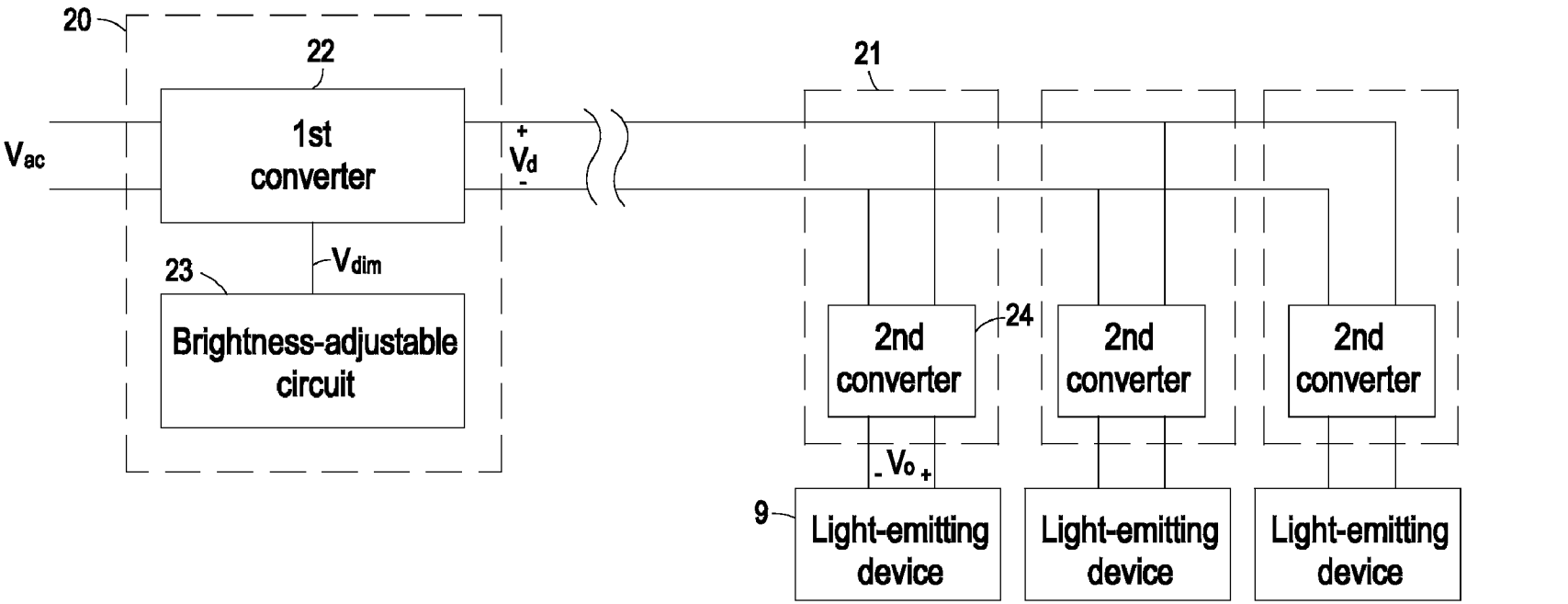
FIG. 3 is a schematic circuit diagram illustrating the brightness-adjustable illumination driving system as shown in FIG. 2.

FIG. 3 is a schematic circuit diagram illustrating the brightness-adjustable illumination driving system as shown in FIG. 2. Please refer to FIG. 2 and FIG. 3. The control unit 20 comprises a first converter 22 and a brightness-adjustable circuit 23. The control unit 20 is used for driving illumination of the light-emitting devices 9 and adjusting the brightness values of the light-emitting devices 9. A first input terminal of the first converter 22 is connected to a power source (e.g. a utility source) for receiving an input AC voltage $V_{ac}$ and converting the input AC voltage $V_{ac}$ into a regulated DC voltage $V_d$. A second input terminal of the first converter 22 is connected to the brightness-adjustable circuit 23 for receiving a brightness adjusting signal $V_{dim}$ from the brightness-adjustable circuit 23. According to the brightness adjusting signal $V_{dim}$, the magnitude of the regulated DC voltage $V_d$ is adjusted by the first converter 22. In some embodiments, the control unit 20 further comprises a user operation interface (not shown) such as a knob. Via the user operation interface, the user can control the brightness-adjustable circuit 23 to generate various brightness adjusting signals $V_{dim}$.

The bases 21 are separated from the control unit 20 and used for supporting respective light-emitting devices 9. Each base 21 comprises a second converter 24. The second converters 24 of these bases 24 are connected with each other in parallel. The input terminals of the second converters 24 are connected to the output terminals of the first converter 22. The output terminals of the second converters 24 are connected to respective light-emitting devices 9. The regulated DC voltage $V_d$ is received by the second converter 24 and converted into an output voltage $V_o$ for driving illumination of a corresponding light-emitting device 9. Moreover, in a case that the magnitude of the regulated DC voltage $V_d$ is adjusted by the first converter 22, the magnitude of the output voltage $V_o$ is adjusted and thus the brightness value of the light-emitting device 9 is changed.

Please refer to FIG. 2 and FIG. 3 again. The brightness-adjustable circuit 23 can generate various brightness adjusting signals $V_{dim}$ to the first converter 22. According to the brightness adjusting signals $V_{dim}$, the input AC voltage $V_{ac}$ is converted into corresponding regulated DC voltages $V_d$. The regulated DC voltage $V_d$ are received by the second converter 24 and converted into an output voltage $V_o$ for driving illumination controlling the brightness value of a corresponding light-emitting device 9. That is, the control unit 20 can remotely adjust the brightness value of the light-emitting devices 9 by controlling the brightness-adjustable circuit 23.

FIG. 4 is a schematic detailed circuit diagram of the brightness-adjustable illumination driving system as shown in FIG. 3. As shown in FIG. 4, the first converter 22 of the control unit 20 comprises a feedback circuit 220, an AC-to-DC converting circuit 221 and a DC-to-DC converting circuit 222. The input AC voltage $V_{ac}$ is received by the AC-to-DC converting circuit 221 and converted into a transition DC voltage $V_3$ by the AC-to-DC converting circuit 221. An example of the AC-to-DC converting circuit 221 includes but is not limited to a boost converting circuit. The AC-to-DC converting circuit 221 principally comprises a rectifying circuit 223, an inductor $L_1$, a first switching circuit 224, a first pulse width modulation (PWM) controller 225 and a first rectifying and filtering circuit 226. The rectifying circuit 223 is connected to the input terminal of the AC-to-DC converting circuit 221 for rectifying the input AC voltage $V_{ac}$ into a rectified DC voltage $V_1$. An end of the inductor $L_1$ is connected to the rectifying circuit 223. The other end of the inductor $L_1$ is connected to the first switching circuit 224 and the first rectifying and filtering circuit 226. The rectified DC voltage $V_1$ is transmitted from the rectifying circuit 223 to the inductor $L_1$. According to the switching statuses of the first switching circuit 224, the electric energy of the rectified DC voltage $V_1$ is charged into the inductor $L_1$ or the inductor $L_1$ discharges the stored electric energy to generate a boost voltage $V_2$.

The first switching circuit 224 is connected to the inductor $L_1$, the first rectifying and filtering circuit 226, the first PWM controller 225, and a common terminal. Under control of the first PWM controller 225, the first switching circuit 224 is alternately conducted or shut off. In this embodiment, the first switching circuit 224 includes a first switch element $Q_1$.

The first rectifying and filtering circuit 226 is connected to the inductor $L_1$ and the output terminal of the AC-to-DC converting circuit 221. The first rectifying and filtering circuit 226 is used for rectifying and filtering the boost voltage $V_2$, thereby generating the transition DC voltage $V_3$. In this embodiment, the first rectifying and filtering circuit 226 comprises a first diode $D_1$ and a first capacitor $C_1$. The positive end of the first diode $D_1$ is connected to the inductor $L_1$ and the first switching circuit 224. The negative end of the first diode $D_1$ is connected to an end of the first capacitor $C_1$. The other end of the first capacitor $C_1$ is connected to the common terminal.

The input terminal of the DC-to-DC converting circuit 222 is connected to the output terminal of the AC-to-DC converting circuit 221. The transition DC voltage $V_3$ is transmitted from the AC-to-DC converting circuit 221 to the DC-to-DC converting circuit 222 and converted into the regulated DC voltage $V_d$ by the DC-to-DC converting circuit 222. In this embodiment, the DC-to-DC converting circuit 222 is a buck converting circuit, but it is not limited thereto. The DC-to-DC converting circuit 222 comprises a second switching circuit 227, a first transformer $T_1$, a second PWM controller 228 and a second rectifying and filtering circuit 229. The second switching circuit 227 is connected to the output terminal of the AC-to-DC converting circuit 221, the second PWM controller 228 and the first transformer $T_1$. Under control of the second PWM controller 228, the second switching circuit 227 is alternately conducted or shut off.

The primary winding assembly $N_p$ of the first transformer $T_1$ is connected to the second switching circuit 227 and the common terminal. During the second switching circuit 227 is alternately conducted or shut off, the transition DC voltage $V_3$ is transmitted from the AC-to-DC converting circuit 221 to the primary winding assembly $N_p$ of the first transformer $T_1$. The electric energy stored in the primary winding assembly $N_p$ is magnetically transmitted to the secondary winding assembly $N_s$ of the first transformer $T_1$. As such, the secondary winding assembly $N_s$ generates a converted voltage $V_4$. The second rectifying and filtering circuit 229 is connected to the secondary winding assembly $N_s$ of the first transformer $T_1$, the feedback circuit 220 and the output terminal of the DC-to-DC converting circuit 222. The second rectifying and filtering circuit 229 is used for rectifying and filtering the converted voltage $V_4$, thereby generating the regulated DC voltage $V_d$.

The DC-to-DC converting circuit 222 further comprises a reset capacitor $C_c$. The reset capacitor $C_c$ is connected to the second switching circuit 227 and the primary winding assembly $N_p$ of the first transformer $T_1$. By discharging the electrical energy stored in the reset capacitor $C_c$, the electric energy of the primary winding assembly $N_p$ of the first transformer $T_1$ is reset. The second switching circuit 227 comprises a second switch element $Q_2$ and a third switch element $Q_3$. The second switch element $Q_2$ is connected to the output terminal of the AC-to-DC converting circuit 221, the reset capacitor $C_c$, the third switch element $Q_3$ and the second PWM controller 228. The third switch element $Q_3$ is connected to the second switch element $Q_2$, the reset capacitor $C_c$, the second PWM controller 228 and the common terminal. Under control of the second PWM controller 228, the second switch element $Q_2$ and the third switch element $Q_3$ are alternately conducted or shut off. In this embodiment, the second rectifying and filtering circuit 229 comprises a second diode $D_2$, a third diode $D_3$ and a second capacitor $C_2$. The positive ends of the second diode $D_2$ and the third diode $D_3$ are connected to the secondary winding assembly $N_s$ of the first transformer $T_1$. The negative ends of the second diode $D_2$ and the third diode $D_3$ are connected to an end of the second capacitor $C_2$. The other end of the second capacitor $C_2$ is connected to the common terminal.

A first input terminal of the feedback circuit 220 is connected to the output terminal of the DC-to-DC converting circuit 222. A second input terminal of the feedback circuit 220 is connected to the brightness-adjustable circuit 23. The output terminal of the feedback circuit 220 is connected to the second PWM controller 228 of the DC-to-DC converting circuit 222. According to the regulated DC voltage $V_d$ issued from the DC-to-DC converting circuit 222 and the brightness adjusting signal $V_{dim}$ issued from the brightness-adjustable circuit 23, the feedback circuit 220 generates a feedback signal $V_{fb}$ to the second PWM controller 228. According to the feedback signal $V_{fb}$, the second PWM controller 228 controls the duty cycle of the second switching circuit 227, thereby adjusting the magnitude of the regulated DC voltage $V_d$. In this embodiment, the feedback circuit 220 comprises a first resistor $R_1$, a signal controlling circuit 220*a* and an isolation circuit 220*b*. A first input terminal of the signal controlling circuit 220*a* is connected to the output terminal of the DC-to-DC converting circuit 222. A second input terminal of the signal controlling circuit 220*a* is connected to the brightness-adjustable circuit 23. The output terminal of the signal controlling circuit 220*a* is connected to the input terminal of the isolation circuit 220*b*. According to the regulated DC voltage $V_d$ issued from the DC-to-DC converting circuit 222 and the brightness adjusting signal $V_{dim}$ issued from the brightness-adjustable circuit 23, the signal controlling circuit 220*a* generates a control signal $V_c$ to the isolation circuit 220*b*.

In this embodiment, the signal controlling circuit 220*a* comprises a second resistor $R_2$, a third resistor $R_3$, a third capacitor $C_3$ and a signal amplifier OP. An end of the second resistor $R_2$ is connected to the output terminal of the DC-to-DC converting circuit 222. The other end of the second resistor $R_2$ is connected to an end of the third resistor $R_3$. The other end of the third resistor $R_3$ is connected to the common terminal. The negative end of the signal amplifier OP is connected to the node between the second resistor $R_2$ and the third resistor $R_3$. The regulated DC voltage $V_d$ is received by the negative end of the signal amplifier OP through the second resistor $R_2$. The positive end of the signal amplifier OP is connected to the brightness-adjustable circuit 23 for receiving the brightness adjusting signal $V_{dim}$. The output terminal of the signal amplifier OP is connected to the input terminal of the isolation circuit 220*b*. According to the regulated DC voltage $V_d$ and the brightness adjusting signal $V_{dim}$, the signal amplifier OP issues the control signal $V_c$ to the isolation circuit 220*b*. An end of the third capacitor $C_3$ is connected to the second resistor $R_2$, the third resistor $R_3$ and the negative end of the signal amplifier OP. The other end of the third capacitor $C_3$ is connected to the output terminal of the signal amplifier OP.

The input terminal of the isolation circuit 220*b* is connected to the output terminal of the DC-to-DC converting circuit 222 and the signal controlling circuit 220*a* for receiving the regulated DC voltage $V_d$ and the control signal $V_c$. The output terminal of the isolation circuit 220*b* is connected to the second PWM controller 228 of the DC-to-DC converting circuit 222 and the common terminal. The isolation circuit 220*b* is used for isolating the signal controlling circuit 220*a* from the primary winding assembly $N_p$ of the first transformer $T_1$. In this embodiment, the isolation circuit 220*b* is a photo coupler. Due to the voltage difference between the regulated DC voltage $V_d$ and the control signal $V_c$, the input terminal of the isolation circuit 220*b* will generate a first current $I_1$. According to the first current $I_1$, the output terminal of the isolation circuit 220*b* generates a second current $I_2$. An end of the first resistor $R_1$ is connected to the output terminal of the isolation circuit 220*b* and the second PWM controller 228. The other end of the first resistor $R_1$ is connected to a supply voltage $V_{cc}$. According to the magnitude of the second current $I_2$, the first resistor $R_1$ generates the feedback signal $V_{fb}$ to the second PWM controller 228.

The brightness-adjustable circuit 23 is connected to the feedback circuit 220 for generating the brightness adjusting signal $V_{dim}$ to the feedback circuit 220. In this embodiment, the brightness-adjustable circuit 23 comprises a fourth resistor $R_4$ and a variable resistor $R_{var}$. An end of the fourth resistor $R_4$ receives the supply voltage $V_{cc}$. The other end of the fourth resistor $R_4$ is connected to an end of the variable resistor $R_{var}$ and the feedback circuit 220. The other end of the variable resistor $R_{var}$ is connected to the common terminal. By adjusting the resistance value of the variable resistor $R_{var}$, the brightness-adjustable circuit 23 will generate various brightness adjusting signals $V_{dim}$. As previously described, the control unit 20 further comprises a user operation interface (not shown) such as a knob. Via the user operation interface, the user can control the brightness-adjustable circuit 23 to generate various brightness adjusting signals $V_{dim}$.

Please refer to FIGS. 2, 3 and 4. Each base 21 comprises a second converter 24. The second converter 24 comprises a second transformer $T_2$, a third switching circuit 241 and a third PWM controller 243. The third switching circuit 241 is connected to the primary winding assembly $N_{p1}$ of the second transformer $T_2$ and the output terminal of the first converter 22. Under control of the third PWM controller 243, the third switching circuit 241 is alternately conducted or shut off. The third switching circuit 241 comprises a fourth switch element $Q_4$ and a fifth switch element $Q_5$. The fourth switch element $Q_4$ is connected to the output terminal of the first converter 22, the third PWM controller 243, the primary winding assembly $N_{p1}$ of the second transformer $T_2$ and the fifth switch element $Q_5$. The fifth switch element $Q_5$ is connected to the output terminal of the first converter 22, the third PWM controller 243, the primary winding assembly $N_{p1}$ of the second transformer $T_2$ and the fourth switch element $Q_4$. Under control of the third PWM controller 243, the fourth switch element $Q_4$ and the fifth switch element $Q_5$ are alternately conducted or shut off.

The primary winding assembly $N_{p1}$ of the second transformer $T_2$ is connected to the third switching circuit 241. The secondary winding assembly $N_{s1}$ of the second transformer $T_2$ is connected to the light-emitting device 9. During the third switching circuit 241 is alternately conducted or shut off under control of the third PWM controller 243, the regulated DC voltage $V_d$ is transmitted from the DC-to-DC converting circuit 222 to the primary winding assembly $N_{p1}$ of the second transformer $T_2$. The electric energy stored in the primary winding assembly $N_{p1}$ is magnetically transmitted to the secondary winding assembly $N_{s1}$ of the second transformer $T_2$. As such, the secondary winding assembly $N_s$ generates an output voltage $V_o$ for driving illumination of the light-emitting device 9. In this embodiment, the second converter 24 is a push-pull inverter, but it is not limited thereto. The second converter 24 further comprises at least one current-sharing circuit 242. The current-sharing circuit 242 is connected to the light-emitting device 9 and the secondary winding assembly $N_{s1}$ of the second transformer $T_2$. In a case that several light-emitting devices 9 are supported on the same base 21, the currents flowing through these light-emitting devices 9 are substantially identical by means of the current-sharing circuit 242. In this embodiment, the current-sharing circuit 242 includes for example a capacitor.

Please refer to FIGS. 2, 3 and 4 again. For adjusting the brightness value of the light-emitting device 9, the user may control the brightness-adjustable circuit 23 to generate various brightness adjusting signals $V_{dim}$ via the user operation interface. According to the regulated DC voltage $V_d$ issued from the DC-to-DC converting circuit 222 and the brightness adjusting signal $V_{dim}$ issued from the brightness-adjustable circuit 23, the signal controlling circuit 220*a* of the feedback circuit 220 generates a control signal $V_c$ to the isolation circuit 220*b*. Due to the voltage difference between the regulated DC voltage $V_d$ and the control signal $V_c$ at the input terminal of the isolation circuit 220*b*, the output terminal of the isolation circuit 220*b* of the feedback circuit 220 generates the second current $I_2$. According to the magnitude of the second current $I_2$, the first resistor $R_1$ generates the feedback signal $V_{fb}$ to the second PWM controller 228. According to the feedback signal $V_{fb}$, the second PWM controller 228 controls the duty cycle of the second switching circuit 227, thereby adjusting the magnitude of the regulated DC voltage $V_d$ corresponding to the brightness adjusting signal $V_{dim}$. Moreover, the regulated DC voltage $V_d$ is converted into the output voltage $V_o$ by the second converter 24 of each base 21. By the output voltage $V_o$, the light-emitting device 9 is driven to illuminate a light beam with a desired brightness value.

From the above embodiment, the brightness-adjustable illumination driving system is capable of adjusting the brightness value of a cold cathode fluorescent lamp or a light emitting diode. Since the control unit is separated from the base, the user can control the brightness-adjustable circuit 23 to generate various brightness adjusting signals via the user operation interface. According to the brightness adjusting signal, the magnitude of the regulated DC voltage is adjusted by the first converter. The regulated DC voltage is converted by the second converters of the bases into corresponding output voltage, thereby driving illumination of the light-emitting devices and adjusting the brightness values of the light-emitting devices.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An illumination driving system for driving at least one light-emitting device and controlling a brightness value of said light-emitting device, said illumination driving system comprising:

a control unit comprising a first converter and a brightness-adjustable circuit, wherein an input AC voltage is converted into a regulated DC voltage by said first converter, and said brightness-adjustable circuit is connected to said first converter, wherein said first converter further comprises:

an AC-to-DC converting circuit for receiving said input AC voltage and converting said input AC voltage into a transition DC voltage;

a DC-to-DC converting circuit connected to said AC-to-DC converting circuit for receiving said transition DC voltage and converting said transition DC voltage into said regulated DC voltage; and a feedback circuit connected to said DC-to-DC converting circuit and said brightness-adjustable circuit, wherein said feedback circuit generates a feedback signal according to said regulated DC voltage and said brightness adjusting signal; and at least one base separated from said control unit for supporting said at least one light-emitting device, said base comprising a second converter, wherein said second converter is connected with said first converter and said light-emitting device for converting said regulated DC voltage into an output voltage, and said light-emitting device is driven to illuminate by said output voltage, wherein said brightness-adjustable circuit generates a brightness adjusting signal to said first converter, and the magnitude of said regulated DC voltage is adjusted according to said brightness adjusting signal, thereby adjusting said brightness value of said light-emitting device.

2. The illumination driving system according to claim 1 wherein said light-emitting device is a cold cathode fluorescent lamp or a light emitting diode.

3. The illumination driving system according to claim 1 wherein said AC-to-DC converting circuit is a boost converting circuit.

4. The illumination driving system according to claim 1 wherein said AC-to-DC converting circuit comprises:

a rectifying circuit for rectifying said input AC voltage into a rectified DC voltage;

an inductor having an end connected to said rectifying circuit;

a first switching circuit connected to the other end of said inductor;

a first pulse width modulation controller connected to said first switching circuit for controlling on/off statuses of said first switching circuit, so that said inductor generates a boost voltage; and a first rectifying and filtering circuit connected to said inductor and an output terminal of said AC-to-DC converting circuit for rectifying and filtering said boost voltage, thereby generating said transition DC voltage.

5. The illumination driving system according to claim 4 wherein said first rectifying and filtering circuit comprises a first diode and a first capacitor, wherein a positive end of said first diode is connected to said inductor, a negative end of said first diode is connected to an end of said first capacitor, and the other end of said first capacitor is connected to a common terminal.

6. The illumination driving system according to claim 1 wherein said DC-to-DC converting circuit comprises:

a second switching circuit connected to an output terminal of said AC-to-DC converting circuit;

a second pulse width modulation controller connected to said second switching circuit and said feedback circuit for controlling on/off statuses of said second switching circuit;

a first transformer connected to said second switching circuit for receiving said transition DC voltage and converting said transition DC voltage into a converted voltage during said second switching circuit is alternately conducted or shut off; and a second rectifying and filtering circuit connected to said first transformer and an output terminal of said DC-to-DC converting circuit for rectifying and filtering said converted voltage, thereby generating said regulated DC voltage.

7. The illumination driving system according to claim 6 wherein said second rectifying and filtering circuit comprises a second diode, a third diode and a second capacitor, positive ends of said second diode and said third diode are connected to said first transformer, negative ends of said second diode and said third diode are connected to an end of said second capacitor, and the other end of said second capacitor is connected to a common terminal.

8. The illumination driving system according to claim 6 wherein said DC-to-DC converting circuit further comprises a reset capacitor, wherein said reset capacitor has an end connected to said second switching circuit and the other end connected to said first transformer, thereby resetting the electric energy stored in said primary winding assembly of said first transformer.

9. The illumination driving system according to claim 6 wherein said feedback circuit comprises:

a signal controlling circuit connected to said brightness-adjustable circuit and an output terminal of said DC-to-DC converting circuit, wherein said signal controlling circuit generates a control signal according to said regulated DC voltage and said brightness adjusting signal;

an isolation circuit connected to said signal controlling circuit, an output terminal of said DC-to-DC converting circuit and said second pulse width modulation controller for isolating said feedback circuit from said primary winding assembly of said first transformer, wherein said isolation circuit generates an output current according to said control signal and said regulated DC voltage; and a first resistor having an end receiving a supply voltage and the other end connected to said isolation circuit and said second pulse width modulation controller, wherein said first resistor generates a feedback signal to said second pulse width modulation controller according to the magnitude of said output current, and said second pulse width modulation controller controls the duty cycle of said second switching circuit according to said feedback signal, thereby adjusting the magnitude of the regulated DC voltage.

10. The illumination driving system according to claim 9 wherein said signal controlling circuit comprises a second resistor, a third resistor, a third capacitor and a signal amplifier, wherein an end of said second resistor is connected to said DC-to-DC converting circuit, the other end of said second resistor is connected to an end of said third resistor, the other end of said third resistor is connected to a common terminal, a negative end of said signal amplifier is connected to a node between said second resistor and said third resistor, a positive end of said signal amplifier is connected to said brightness-adjustable circuit, and an output terminal of said signal amplifier is connected to said isolation circuit.

11. The illumination driving system according to claim 9 wherein said isolation circuit is a photo coupler.

12. The illumination driving system according to claim 9 wherein said brightness-adjustable circuit is connected to said feedback circuit and comprises a fourth resistor and a variable resistor, wherein an end of said variable resistor is connected to a common terminal, the other end of said variable resistor is connected to an end of said fourth resistor and said feedback circuit, and the other end of fourth resistor is connected to a supply voltage.

13. The illumination driving system according to claim 1 wherein said second converter comprises:

a third switching circuit connected to said first converter;

a third pulse width modulation controller connected to said third switching circuit for controlling on/off statuses of said third switching circuit; and a second transformer connected to said third switching circuit and said light-emitting device for receiving said regulated DC voltage and converting said regulated DC voltage into said output voltage during said third switching circuit is alternately conducted or shut off.

14. The illumination driving system according to claim 13 wherein said second converter further comprises at least one current-sharing circuit connected to said second transformer and said at least one light-emitting device, wherein multiple light-emitting devices are supported on said base, and the currents flowing through said light-emitting devices are substantially identical by said current-sharing circuit.

15. The illumination driving system according to claim 1 wherein said second converter is a push-pull inverter.

16. The illumination driving system according to claim 1 wherein said illumination driving system comprises multiple bases, said bases have respective second converters connected with each other in parallel, and said second converters are connected to said first converter and respective light-emitting devices.

* * * * *